US009441172B2

(12) United States Patent
Knickerbocker et al.

(10) Patent No.: US 9,441,172 B2
(45) Date of Patent: Sep. 13, 2016

(54) PETROLEUM REFINERY MERCURY CONTROL

(71) Applicants: Bryan M. Knickerbocker, Centreville, VA (US); Robert James Falkiner, Brampton (CA)

(72) Inventors: Bryan M. Knickerbocker, Centreville, VA (US); Robert James Falkiner, Brampton (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 310 days.

(21) Appl. No.: 14/305,468

(22) Filed: Jun. 16, 2014

(65) Prior Publication Data

US 2015/0361353 A1 Dec. 17, 2015

(51) Int. Cl.
*C10G 45/02* (2006.01)
*C10G 29/02* (2006.01)

(52) U.S. Cl.
CPC ..... *C10G 45/02* (2013.01); *C10G 29/02* (2013.01)

(58) Field of Classification Search
CPC ..... C10G 29/00; C10G 29/02; C10G 45/02; C10G 45/00
See application file for complete search history.

(56) References Cited

U.S. PATENT DOCUMENTS 3,740,331 A 6/1973 Anderson et al.
4,786,483 A 11/1988 Audeh
4,892,567 A 1/1990 Yan
5,248,488 A 9/1993 Yan
5,409,599 A 4/1995 Harandi
5,599,515 A 2/1997 Misra et al.
6,165,366 A 12/2000 Sarangapani
6,350,372 B1 * 2/2002 Degnan ..... C10G 25/00 208/182
6,635,182 B1 10/2003 Coleman
8,034,246 B2 10/2011 Gustafsson
2003/0082084 A1 5/2003 Cort

OTHER PUBLICATIONS

Yan et al., "Simultaneous Removal of Mercury and Water from Cracked Gas", Chemical Health & Safety, 1995, 37.

* cited by examiner

*Primary Examiner* — Renee E Robinson
*Assistant Examiner* — Derek Mueller
(74) *Attorney, Agent, or Firm* — Glenn T. Barrett; Andrew T. Ward

(57) ABSTRACT

The mercury in crude oils is managed during the refining process to reduce its occurrence in refined petroleum products as well as in refinery emissions and wastes by converting the mercury, which may typically be present in the crude in elemental, ionic or combined organic (organomercury) forms, by operating the refinery on a blend of crudes comprising a mercury-containing crude of low sulfur content and a high sulfur crude. For optimal mercury control, the refinery should be operated in a high conversion regime, preferably with hydroprocessing (severe hydrotreating, hydrocracking) suitable for converting refractory, non-reactive sulfur compounds in the high sulfur crudes to more reactive forms including, for example, hydrogen sulfide, which will combine with the mercury present from the mercury-containing crude to form solid mercury sulfides which may be removed as solid waste by-products and disposed of in an environmentally acceptable manner.

12 Claims, 3 Drawing Sheets

PETROLEUM REFINERY MERCURY CONTROL

FIELD OF THE INVENTION

This invention relates to methods for the control of mercury in petroleum refineries and more particularly, to methods for monitoring and managing the mercury risk within refineries by utilization of sulfur monitoring and management.

BACKGROUND OF THE INVENTION

Mercury is a trace contaminant in all organic matter, including fossil fuels such as coal, petroleum and natural gas. Crude oil can contain a variety of heavy metal contaminants which, during the various processes which are utilized within an oil refinery, are distributed across many of the intermediate and product streams. Whilst the fate and effect of metals such as vanadium and nickel on refining processes are well understood, the concentrations and distribution of mercury are less clear although the presence of mercury in refinery products and discharges and emissions of mercury from the refinery are undesirable: for the fossil fuel and petrochemical industries, proper management of mercury can help prevent harmful effects on human and animal health, the environment, as well as on equipment.

Many sources of crude oil can contain mercury—crudes from Western Europe, Asia, the Middle East and North America have been reported to contain around 100 ppb of mercury. It is expected that much of the mercury in crude oil and refined product streams will exist in its elemental form. Elemental mercury is a relatively low boiling species and in this form it is likely to fractionate primarily into low boiling and naphtha streams as well as into light gas. This mercury can poison catalysts, prevent a final product stream from the refinery from meeting specification and also contribute to premature equipment failure. In the petrochemical industry, for example, the formation of mercury amalgams in the aluminum alloy cold boxes of ethylene crackers is a serious problem as described in *Simultaneous Removal of Mercury and Water from Cracked Gas*, Yan et al, Chemical Health & Safety, Nov./Dec. 1995, 37. Various control and mitigation techniques have been proposed. U.S. Pat. No. 4,892,567 (Yan) describes the use of a silver zeolite-A catalyst for simultaneous mercury and water removal. Other proposals have involved the use of sulfur compounds to convert elemental mercury to insoluble sulfides which can then be removed by conventional filtration. U.S. Pat. No. 5,248,488 (Yan) discloses the use of various sulfur compounds for mercury removal followed by amine treatment to remove unreacted sulfur compounds. U.S. Pat. No. 4,786,483 (Audeh), for example, proposes control strategy by the use of peroxomonosulfates for removing both mercury and hydrogen sulfide. At the present time, Johnson Matthey Catalysts markets the PURASPECJM™ products which are designed to allow the effective removal of mercury from naphtha and other gaseous effluent streams.

The mercury removal method described by Yan in U.S. Pat. No. 4,892,567 using the silver-promoted molecular sieve (HgSIV) to absorb Hg in driers does raise the difficulty that the Hg/Ag amalgam decomposes during regeneration and the Hg in the off-gas must be managed in a secondary treater.

Another area of concern is the discharge of mercury in refinery waste streams, particularly waste water. Wastewater treating additives such as NALMET™ and METCLEAR™ from vendors such as Nalco and GE are reported to include sulfur-containing species such as dithiocarbamates that react with mercury to form a solid that can be removed from water by filtration. NUCON International offers a variety of chemicals for mercury removal under the title of MERSORB™ Mercury Adsorbents.

U.S. Pat. No. 5,667,694 (Cody), describes a heavy metal removal process using clay sorbents; U.S. Pat. No. 6,635,182 (Coleman) discloses the use of flocculants/scavengers such as the dithiocarbamates in the treatment of wastewater streams containing heavy metals including mercury by the formation of a floc which is subsequently removed by means of air flotation. U.S. Pat. No. 5,599,515 (Misra) discloses the use of dialkyldithiocarbamates to form stable mercury precipitates followed by flotation to remove the precipitate. U.S. Pat. No. 3,740,331 (Anderson) refers to the difficulties in removing ionic mercury by precipitation as a sulfide. US Patent Publication No. 2003/0082084 (Cort) discloses a two-step metal removal process applicable to mercury removal which combines hydroxide or sulfide precipitation with a physical removal. U.S. Pat. No. 6,165,366 (Sarangapani) discloses a process for mercury removal by oxidation using hypochlorite followed by filtration. U.S. Pat. No. 8,034,246 (Gustafsson) discloses a method for removing elemental and ionic mercury from wastewater streams by precipitation, flotation, filtration and carbon polishing.

A common way to manage mercury conventionally involved the use of what can be described as "on purpose sulfur addition". For example, a refiner might add "Mercury Removal Units", or MRUs, to the back end of the refinery, to remove mercury from specific product streams. These MRUs could consist of beds of a purchased, sulfur-impregnated solid over which the hydrocarbon products are passed. This would result in the formation of low-mercury products, plus a waste stream containing solid mercury sulfide. The waste stream, consisting of solid adsorbent with mercury sulfide, would then be disposed of properly.

Mercury removal units, sometimes called "Mercury Traps" may be added to the back end of a refinery, for example in the LPG train. These units often consist of a fixed bed containing a sulfur-impregnated solid such as the PURASPECJM™ absorbent mentioned above. The sulfur reacts with mercury to form solid mercury sulfide. The solid absorbent is dumped when it reaches its mercury capacity, and replaced with a fresh absorbent. The used solid absorbent from the MRU contains a higher concentration of mercury than the original crude oil, and can be disposed of in an environmentally acceptable manner. The hydrocarbon streams from the refinery, such as LPG, are now very low in mercury, and can be sold to customers without creating innumerable point sources of mercury pollution. This approach is conventionally adopted by refineries which knowingly process high mercury crudes.

Many refineries do not have mercury removal units. Instead, they avoid intentionally running high mercury crudes. However, to operate reliably in this mode with only low mercury crudes, a refiner requires a knowledge of the mercury content of each crude. This information is not readily available, for two reasons. First, it is difficult to measure the mercury content of a crude oil. The recent ASTM test D7622-10e1 Standard Test Method for Total Mercury in Crude Oil Using Combustion and Direct Cold Vapor Atomic Absorption Method with Zeeman Background Correction requires specialized equipment, as well as very special sample handling, in order to get an accurate result and, second, suppliers often blend crude oils together, either intentionally, when a supplier chooses to blend crude from one reservoir (possibly with higher mercury), with crude from another (possibly with low mercury) or unintentionally, when a supplier allows two crudes to be mingled, for example when filling a cargo ship carrying crude without having carefully cleaned the cargo tanks in the ship, which might contain some amount of the prior cargo.

With mercury management in the refining industry now becoming an area of increasing focus, various regulatory agencies and refinery customers are imposing limits on mercury in products and refinery discharges. Some refineries are considering and/or installing equipment to manage mercury. Other refineries reduce their mercury risk by avoiding high mercury crudes, some do not know the mercury content of their incoming crudes and do not have any active controls for mercury.

SUMMARY OF THE INVENTION

We have now developed improved methods for managing mercury within a petroleum refinery or petrochemical plant receiving refinery hydrocarbon streams. These methods are based upon our confirmation that known crudes with high mercury contents are very low in sulfur and, conversely, that all known crudes with high sulfur contents contain only minimal levels of mercury. Empirical data has shown that mercury in hydrocarbon products is strongly affected by the overall sulfur in the crude slate of the individual refinery. The specific techniques for managing mercury within a refinery are then based on the control of the overall sulfur in the refinery feedstock. In this way, a refinery can manage mercury without the need for other methods, for example avoiding the need for methods requiring "on purpose sulfur addition".

This invention provides a simple method for managing mercury by ensuring that the refinery is always in a "surplus sulfur" situation. As sulfur is an extremely common contaminant for which many mitigation and control techniques exist, the excess sulfur presents no technical obstacle although economics may be more problematical. At the simplest conceptual level, the maintenance of the surplus sulfur requires only that the refiner assure that the refinery feed slate contains sulfur although this may be at a relatively low level, for example above 0.25 weight percent or above 1 weight percent sulfur. This will assure that mercury arriving in the crude will be found predominantly in the form of mercury sulfide, which is largely insoluble in hydrocarbon, and is among the least toxic forms of mercury.

According to the present invention, the mercury from crude oils is managed to reduce its occurrence in refined petroleum products as well as in refinery emissions and wastes by converting the mercury, which may typically be present in the crude in elemental, ionic or combined organic (organomercury) forms, by operating the refinery on a blend of crudes comprising a mercury-containing crude of low sulfur content and a high sulfur crude. For most favorable mercury control, the refinery should be operated in a high conversion regime, preferably with hydroprocessing (severe hydrotreating, hydrocracking) suitable for converting refractory, non-reactive sulfur compounds in the high sulfur crudes to more reactive forms including, for example, hydrogen sulfide, which will combine with the mercury present from the mercury-containing crude to form solid mercury sulfides which may be removed as solid waste by-products and disposed of in an environmentally acceptable manner.

The following description discusses various refinery processing options for dealing with mercury-containing crudes and indicates the preferred options among them.

DRAWINGS

DETAILED DESCRIPTION

Figure 1:
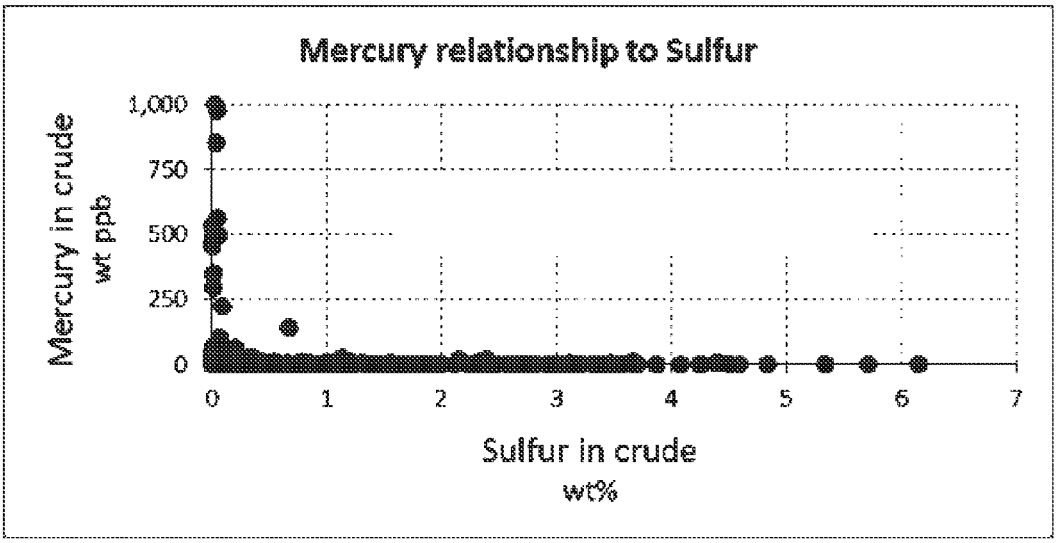
FIG. 1 is a graph based on empirically derived data showing that high sulfur crudes are inherently low in mercury.

FIG. 1 is based on analyses of over 400 crude oils for both mercury and sulfur from all regions and major producers. The Figure shows that there is a strong relationship between mercury and sulfur in crude oil: only crude oils that are very low in sulfur—for example, less than 0.25 wt % sulfur—have any tendency to be high in mercury. The data includes materials that are known as "condensates" within the crude trading market; it has been found that the sulfur/mercury relationship is no different for these materials.

Figure 2:
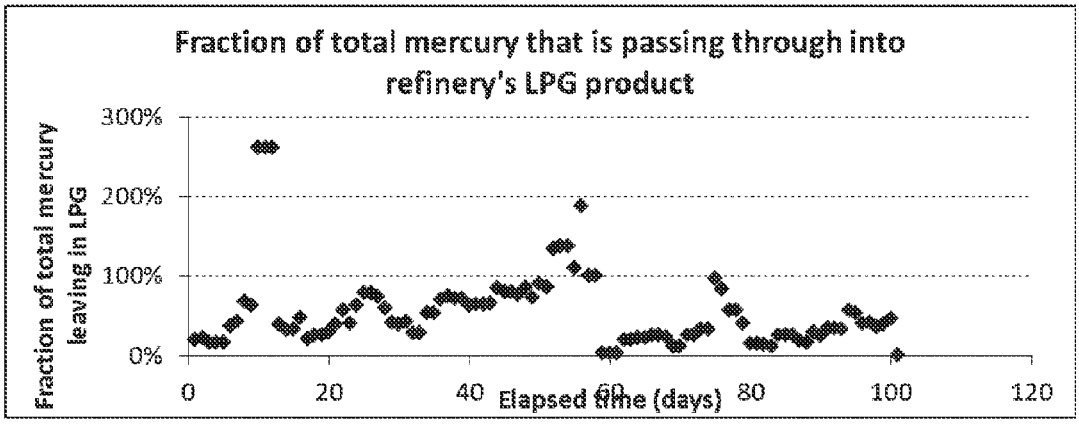
FIG. 2 is a graph based on empirically derived data showing that a significant fraction of mercury passes into LPG product with refineries running low sulfur crudes.

It has also been found that refineries that exclusively run low sulfur crudes are prone to have significant amounts of mercury in their hydrocarbon products and that the product most affected is commonly known as LPG (liquefied petroleum gas), a product that is rich in propane and butane. FIG. 2 shows that there are times when LPG product, on a given day, can contain more mercury than is being brought into the refinery (i.e. LPG contains more than 100% of the refinery mercury input); this is the result of mercury accumulation in the refinery and de-accumulation when this mercury is carried as a micro-droplet or dissolved "slug" into the refinery product. This graph contrasts with the results from high-sulfur refineries, where the hydrocarbon products always show mercury levels at or near the detection limit (i.e. at or below 1 part per billion by weight), regardless of the mercury input to the refinery.

Option 1: Avoiding Low-Sulfur Crudes

The selection of a high sulfur crude either alone or as a blend component with a mercury-containing crude would represent a simple yet efficacious way of dealing with the mercury, especially since the mercury that is contained in refinery solid waste will tend to be in the form of mercury sulfide when adequate sulfur is present in the refinery crude slate to control the mercury. This option would be easily implemented at some refineries. Unfortunately, the sulfur in a high sulfur crude oil may not be in a form that is reactive with mercury. For example, crude oils are known to contain an unreactive sulfur compound known as dibenzothiophene, in which the sulfur is bound with carbon in aromatic rings. Thus, simply mixing a high sulfur crude with a high mercury crude may not bring about any desired chemistry related to controlling the behavior of the mercury. For this reason, the simplest option in implementing a mercury control strategy, requiring only that the refiner avoid purchase of any crude with low sulfur levels, e.g less than 1 wt. % or less than 0.3 wt. % sulfur, e.g. less than 0.25 wt. % sulfur or better, any crude with less than 0.1 wt. % sulfur. Major crude purchases always include basic information about the crude, including sulfur content and so the information requite to the implementation of the strategy will be readily available although, as information about the mercury content is much less widely available and more difficult to obtain, as noted above. This option may however be unattractive to many refineries. Some refineries, particularly older plants, may not have the capability to process high sulfur crude oil. Even plants with adequate sulfur handling capability might profit from purchasing low-sulfur crudes at certain times.

Option 2: Monitoring of Low-Sulfur Crudes, and Avoiding Those High in Mercury

A second option, when a refinery chooses to run a low-sulfur crude, is to ensure that the mercury level in the low-sulfur crude is directly monitored so that adequate measures for its removal can be taken, e.g. by the use of mercury removal units and by wastewater treatment. If a refiner is in a position where crudes with less than 0.25% sulfur are available, the refiner should analyze the low-sulfur crudes for mercury, if this is feasible. Crude oils that are high in mercury (for example, higher than 25 ppb of mercury) should be avoided, unless they are co-processed with high sulfur crudes as discussed in Option 3 below.

This option is not, however, preferred for similar reasons to those discussed above: relying on measurements of mercury in any specific crude can be difficult due to analytical challenges and the potential mixing of crudes from different sources introduces uncertainty about the effectiveness of the strategy.

Option 3: Blending High-Sulfur and Low-Sulfur (Potentially High-Mercury) Crudes Prior to Refining In its preferred implementation, this invention involves co-processing of low sulfur crudes (which are those that have the potential to contain high mercury) and high sulfur crudes (for which mercury is not an issue).

As already discussed, certain sulfur species react readily with mercury. The normal refining process by which high sulfur crudes are turned into products such as low-sulfur diesel provides the capability to convert unreactive sulfur species, such as dibenzothiophenes (including alkyl substituted dibenzothiophenes), into reactive forms such as mercaptans and elemental sulfur which will react with the mercury in the treated fraction to form mercury sulfide as a solid precipitate which can be removed by filtration. Generally, the non-reactive sulfur species will be converted to reactive species by hydroprocessing the fractions derived from the sulfur-containing crude such as by the process described in U.S. Pat. No. 5,409,599 (Harandi), to which reference is made for a description of the process.

Co-processing high sulfur crudes in a refinery, along with high mercury crudes, has the advantage of exposing any mercury that is found in the refinery to reactive sulfur species created during the refining process. This assures that hydrocarbon products are low in mercury, and assures that elemental mercury will not accumulate within the refinery. This avoids the need for additional investment in Mercury Recovery Units, and also protects workers and equipment from potential exposure to elemental mercury. In addition, monitoring the sulfur content of crudes is preferable to monitoring the mercury content. Sulfur is easily measured, and not subject to the same challenges as for mercury. In fact, major refiners already specify in their purchasing contracts that the sulfur of the incoming crude must be measured.

In its preferred option, the overall sulfur in the refinery slate would be higher than 0.5 wt %, and preferably higher than 1.0 wt %. At this level there is enough sulfur within the refinery systems to capture mercury when converted to reactive species, and concentrate it into solid waste, without the need for extra mercury recovery units although attention must be paid to the form of the sulfur: with the crude slate becoming progressively heavier, the proportion of reactive sulfur species will decrease and the proportion of refractory sulfur species such as the dibenzothiophenes will increase. The refining processes should therefore be selected to ensure that the non-reactive, refractory sulfur species are converted to reactive organic forms such as the mercaptans, sulfides and disulfides, or to inorganic from as hydrogen sulfide. The solid waste, containing mercury in the form of mercury sulfide and other insoluble forms of mercury, can be disposed of in a proper manner. In the ideal case, all crudes are mingled before they are first heated to the elevated temperatures used in refining, for example in the initial fractionator. Generally, the blend of sulfur-containing and mercury-containing crudes should be heated to a temperature of at least C, preferably of at least C. If the crudes are not mingled prior to heating, the benefits of co-processing crudes can be diminished or lost. If the identities and proportions of reactive sulfur species in the crudes should be established to ensure that there is sufficient reactive sulfur to precipitate all the expected levels of mercury in the mercury-containing crude, typically at least 0.25 wt. percent and preferably at least 1 wt. percent, reactive sulfur. If sufficient reactive sulfur is not present in the crude, the crude should be processed to convert the non-reactive species to reactive form before co-processing with the mercury-containing crude or the fractions derived from it which are likely to contain the mercury.

Figure 3A:
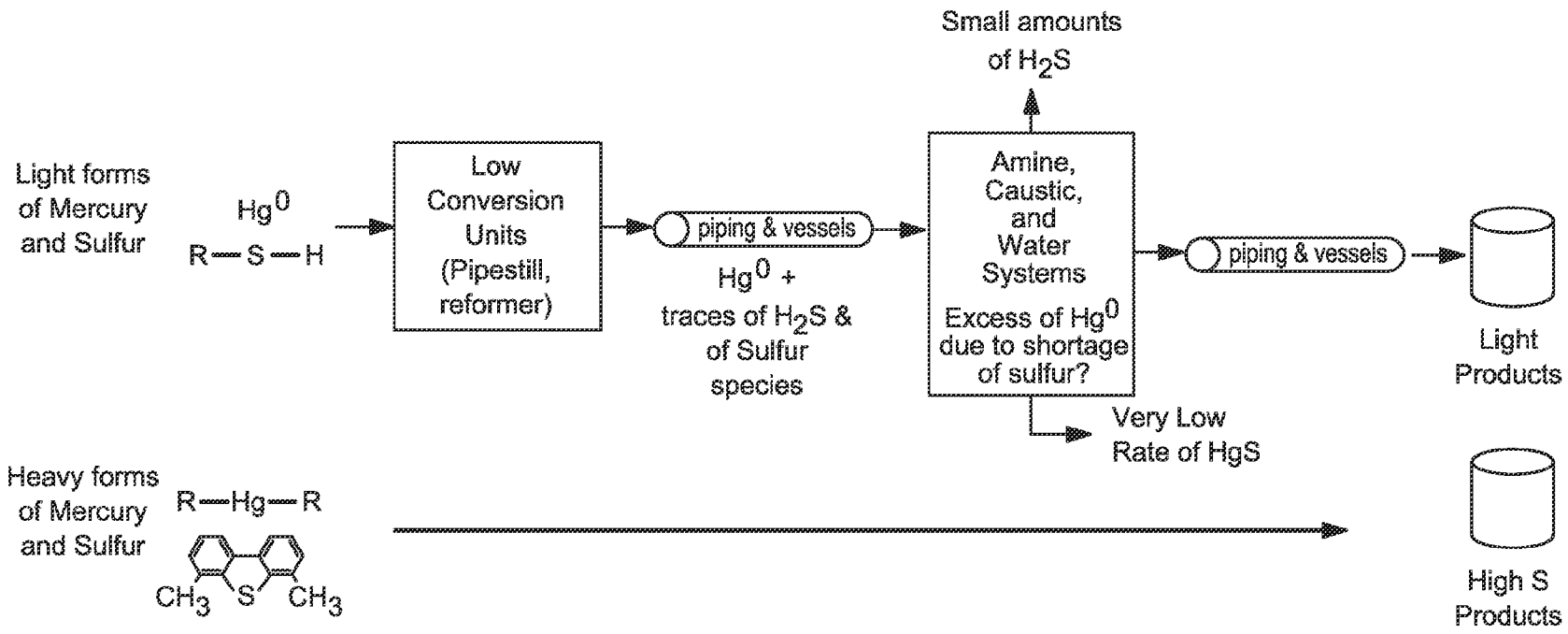
FIG. 3A is a process schematic showing how a low conversion refinery possesses a limited ability to remove mercury.
Figure 3B:
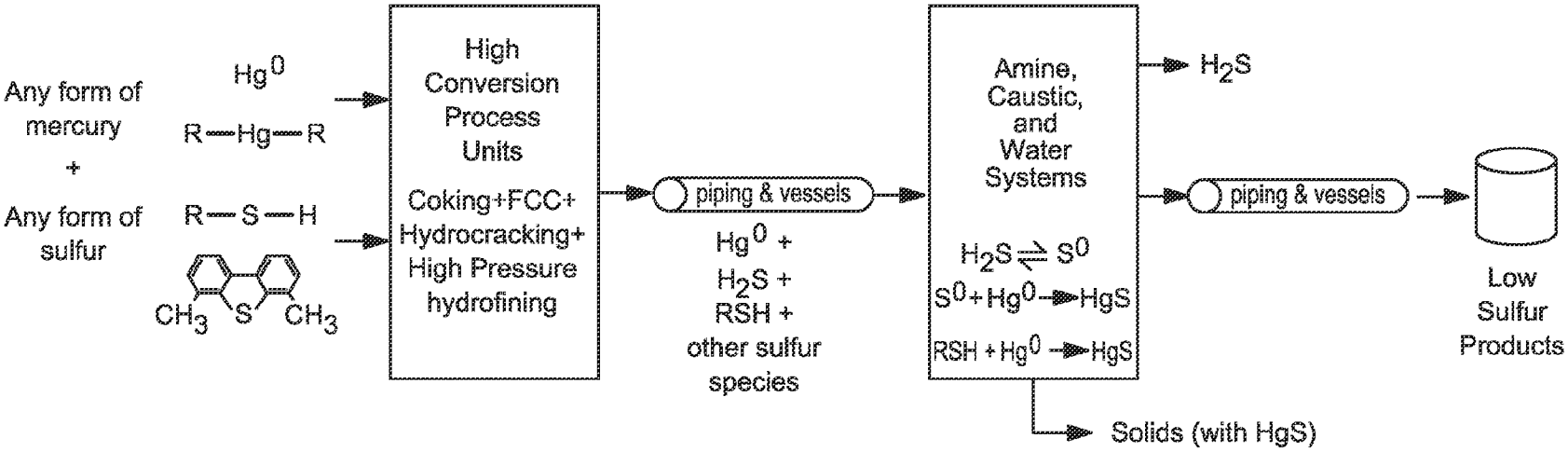
FIG. 3B is a process schematic showing how a high conversion refinery possesses an increased ability to remove mercury.

Option 3 may not however be preferred for low conversion refineries. The ability of a refinery to convert mercury species into mercury sulfide will depend on the configuration of the refinery. Some refineries, often called "low conversion refineries" or "hydroskimming" refineries, have historically sold some high sulfur products that have only gone through a minimum amount of processing. This means that some sulfur species, such as those from the dibenzothiophene family, will remain in unreactive forms, and simply pass through the refinery as depicted in FIG. 3A. In these refineries, the option for simply blending high and low sulfur crudes, without the addition of on-purpose mercury traps, is not preferred. This is because of an increased probability that the light products will contain elevated levels of mercury. More complex refineries with more sulfur conversion capability are the preferred refineries for handling a mixture of low and high sulfur crudes, to produce low mercury refined products with the mercury concentrated in solid wastes with high mercury levels that can be accommodated in waste treatment plants. In these cases, the high levels of conversion achieved in the refinery process units enable the sulfur to be brought into reactive forms in which they can react with the mercury to form solid wastes. This is illustrated in FIG. 3B. In these refineries, the products have lower likelihood for containing elevated levels of mercury, even without on-purpose mercury removal units.

Option 4: Recycle of Sulfur or Sulfur-Containing Streams

A fourth potential implementation for a refiner that is running a crude slate that is deficient in sulfur (for example, an overall slate of much less than 0.25% sulfur) can recycle sulfur from the back of the plant to the front. This can be accomplished by removing the sulfur from the oil as it is being processed in the refinery and recycling it to the front end and bringing it into contact with the crude or with fractions containing the mercury so that a reaction between the mercury and the sulfur species is achieved to convert the mercury to mercury sulfide for ready removal.

Suitable techniques for this purpose involve, for example

Recycle of "sour water" (water that is contaminated with sulfur species) to the refinery desalter system where the water is contacted directly with the crude.

Recycle of product sulfur from the refinery, with the option of an additional step to make the sulfur reactive with mercury.

While the United States Environmental Protection Agency states that elemental sulfur can be used as part of a cleanup kit for small mercury spills, this method is unlikely to be directly applicable to commercial refinery usage and other techniques are preferably employed. One possibility is to capture hydrogen sulfide from hydroprocessing units or from Claus unit $H_2S$ feed and to react the hydrogen sulfide with the elemental mercury. The mercury is reacted with a controlled amount of hydrogen sulfide gas to form mercury sulfide (HgS)

$$H_2S+Hg \rightarrow HgS+H_2$$

The mercury sulfide that is produced may be scrubbed out of the gas as solids in downstream gas cleaning equipment Another option is to convert the elemental sulfur to sulfur dioxide which can be reacted with the mercury in the presence of oxygen to form mercury sulfate according to the reaction:

$$Hg(g)+SO_2(g)+O_2(g) \rightarrow HgSO_4(s)$$

Mercury sulfate can then be removed subsequent scrubbing or electrostatic precipitation stages.

A preferred option for the mercury removal step is described in U.S. patent application Ser. No. 13/568,561 by the recycle of pure sulfur product to the amine treating section of the refinery; the sulfur is converted into a very reactive polysulfide form, which captures mercury. The process is operated by introducing elemental sulfur (e.g. from the Claus unit) into a process stream including HS— and/or $S_2$— ions to react with the HS— and/or $S_2$— ions to generate polysulfide ions which are then reacted with the mercury to form mercury sulfide which can be removed by filtration or centrifugation. The HS— and/or $S_2$-ions in the process stream can be provided, for example, by a rich amine scrubbing agent solvent stream that contains amine hydrosulfide or other hydrosulfide or sulfide ion constituents. Effective amounts of circulating polysulfide ions can be achieved from the reaction between elemental sulfur and the HS— and/or $S_2$— ions to manage mercury levels. Reference is made to Ser. No. 13/568,561 for a detailed description of the process which offers a more attractive alternative to the Ag/Zeolite-A process since the mercury is directly precipitated as a solid without the production of the silver-mercury amalgam.

The invention claimed is:

1. A method for managing the mercury from crude oils during refinery processing to reduce its occurrence in refined petroleum products, refinery emissions and wastes by converting the mercury, which comprises operating the refinery on a blend of crudes comprising a mercury-containing crude of low sulfur content and a high sulfur crude with the blend having a combined sulfur content sufficient upon reaction with the mercury in the blend, to form mercury sulfide(s) which are removed from the refinery products as solid wastes.

2. A method according to claim 1 in which the mercury is present in the mercury-containing crude as elemental mercury.

3. A method according to claim 1 in which the mercury is present in the mercury-containing crude as ionic mercury.

4. A method according to claim 1 in which the mercury is present in the mercury-containing crude as organomercury compounds.

5. A method according to claim 1 in which the refinery is operated in a high conversion mode to convert sulfur compounds in the high sulfur crude to sulfur compounds reactive with the mercury from the mercury-containing crude.

6. A method according to claim 5 in which the refinery is operated with hydroprocessing of fractions from the high sulfur crude which converts refractory, non-reactive sulfur compounds in the high sulfur crudes to forms which contact the mercury present from the mercury-containing crude to form solid mercury sulfides.

7. A method according to claim 1 in which the blend of crudes contains at least 0.25 wt. percent sulfur.

8. A method according to claim 1 in which the blend of crudes contains at least 1 wt. percent sulfur.

9. A method according to claim 1 in which the blend of crudes contains at least 0.25 wt. percent reactive sulfur.

10. A method according to claim 1 in which the blend of crudes contains at least 1.0 wt, percent reactive sulfur.

11. A method according to claim 1 in which the mercury-containing crude of low sulfur content contains not more than 1 wt. percent sulfur.

12. A method according to claim 1 in which the mercury-containing crude of low sulfur content contains not more than 0.3 wt. percent sulfur.

* * * * *